US007805900B2

(12) United States Patent
Kelly

(10) Patent No.: US 7,805,900 B2
(45) **Date of Patent: *Oct. 5, 2010**

(54) FIBERGLASS REINFORCED SPRAY FOAM ROOF CONSTRUCTION

(76) Inventor: Thomas L. Kelly, 31 Sands St., Waterbury, CT (US) 06710

( * ) Notice: Subject to any disclaimer, the term of this patent is extended or adjusted under 35 U.S.C. 154(b) by 1041 days.

This patent is subject to a terminal disclaimer.

(21) Appl. No.: 10/923,933

(22) Filed: Aug. 23, 2004

(65) Prior Publication Data

US 2006/0053702 A1 Mar. 16, 2006

(51) Int. Cl.
*E04C 1/00* (2006.01)

(52) U.S. Cl. ..... 52/309.2; 52/309.4; 52/784.15; 52/746.11

(58) Field of Classification Search ..... 52/309.4, 52/309.8, 410, 783.11, 783.14, 784.15, 676, 52/746.11, DIG. 15, 450, 309.2
See application file for complete search history.

(56) References Cited

U.S. PATENT DOCUMENTS 2,245,689 A * 6/1941 Krueger ..... 52/88
2,484,695 A * 10/1949 Dickey et al. ..... 52/450
3,300,912 A * 1/1967 Shumaker ..... 52/39
3,397,497 A * 8/1968 Shea et al. ..... 52/334
3,482,367 A * 12/1969 Curran ..... 52/309.9
3,956,864 A * 5/1976 Fung ..... 52/414
4,106,249 A * 8/1978 Morton ..... 52/336
4,348,846 A * 9/1982 Bellem ..... 52/410
4,558,550 A * 12/1985 Marchais et al. ..... 52/309.7
4,630,421 A * 12/1986 Diehl et al. ..... 52/408
4,783,942 A * 11/1988 Nunley et al. ..... 52/309.1
5,088,259 A * 2/1992 Myers ..... 52/410
5,516,953 A * 5/1996 Feldman et al. ..... 585/366
5,584,153 A * 12/1996 Nunley et al. ..... 52/410
5,600,929 A * 2/1997 Morris ..... 52/309.8
5,842,315 A * 12/1998 Lin ..... 52/309.9
5,979,133 A * 11/1999 Funkhouser ..... 52/408
6,416,854 B2 * 7/2002 Hunter, Jr. ..... 428/319.1
6,418,678 B2 * 7/2002 Rotter ..... 52/199
6,742,315 B2 * 6/2004 Linn ..... 52/745.1
6,944,997 B2 * 9/2005 Verkamp ..... 52/309.4
7,454,876 B2 * 11/2008 Kelly ..... 52/746.11

* cited by examiner

*Primary Examiner*—Richard E Chilcot, Jr.
*Assistant Examiner*—Chi Nguyen
(74) *Attorney, Agent, or Firm*—Cantor Colburn LLP

(57) ABSTRACT

Disclosed herein is a roof structure including a deck air sealed by expanding foam and wherein a mesh material is upwardly adjacent the deck and embedded in the expanding foam or in additional expanding foam.

Further disclosed herein is a method for making a roof which includes applying a foam material to a roof deck and embedding a mesh in the foam.

2 Claims, 4 Drawing Sheets

FIBERGLASS REINFORCED SPRAY FOAM ROOF CONSTRUCTION

BACKGROUND

Many roof constructions are known to the art with nearly all being concerned with not only waterproofness but wind uplift. Wind uplift is a serious concern for large expanse buildings where an entire roof can be blown off by the low pressure created thereabove by swiftly moving and tumbling air. Because of these concerns, prior art roofs can be complex and time consuming to build.

Another concern of the commercial roofing industry is fire proofing. Fireproofing traditionally requires additional layers and structures which further complicate the roof structure.

While roofs of the prior art do function well for their intended purpose, easier to install structures that have the same or greater benefits than those of the prior art would be welcomed.

SUMMARY

Disclosed herein is a roof structure including a deck air sealed by expanding foam and wherein a mesh material is upwardly adjacent the deck and embedded in the expanding foam or in additional expanding foam.

Further disclosed herein is a method for making a roof which includes applying a foam material to a roof deck and embedding a mesh in the foam.

BRIEF DESCRIPTION OF THE FIGURES

Referring now to the drawings wherein like elements are numbered alike in the several figures.

DETAILED DESCRIPTION OF THE PREFERRED EMBODIMENTS

Figure 1:
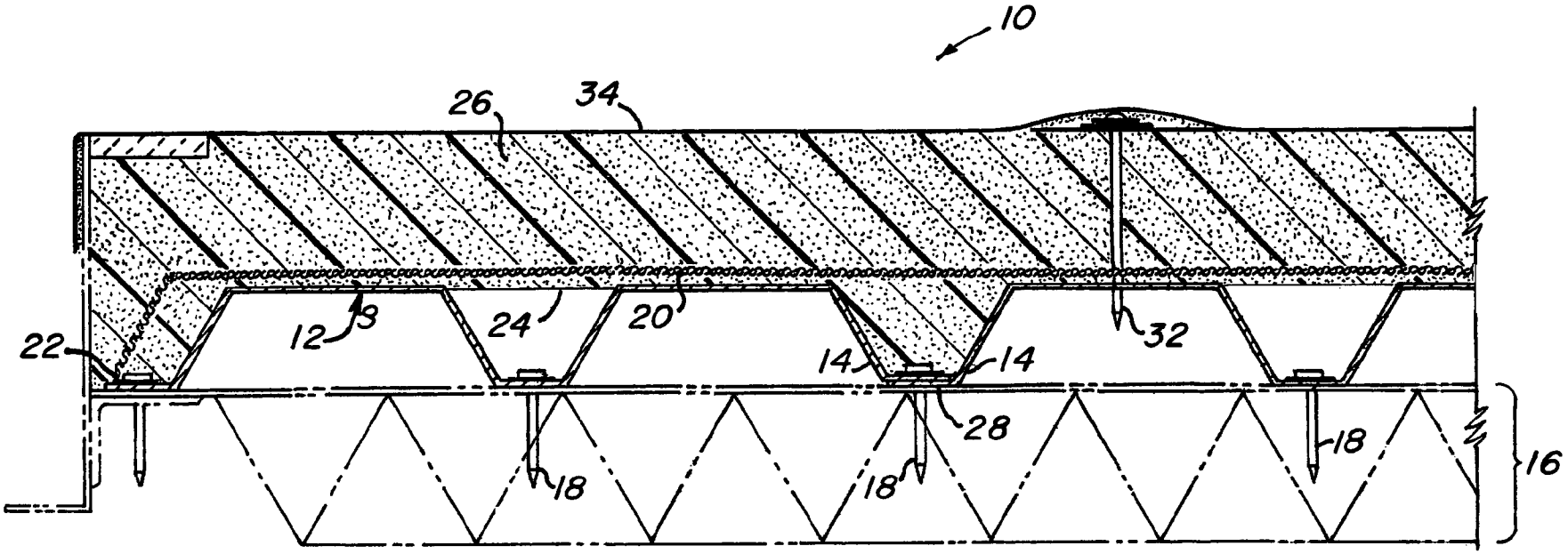
FIG. 1 is an cross-sectional elevation view of a mesh reinforced foam roof structure employing the teachings enumerated herein.
Figure 6:
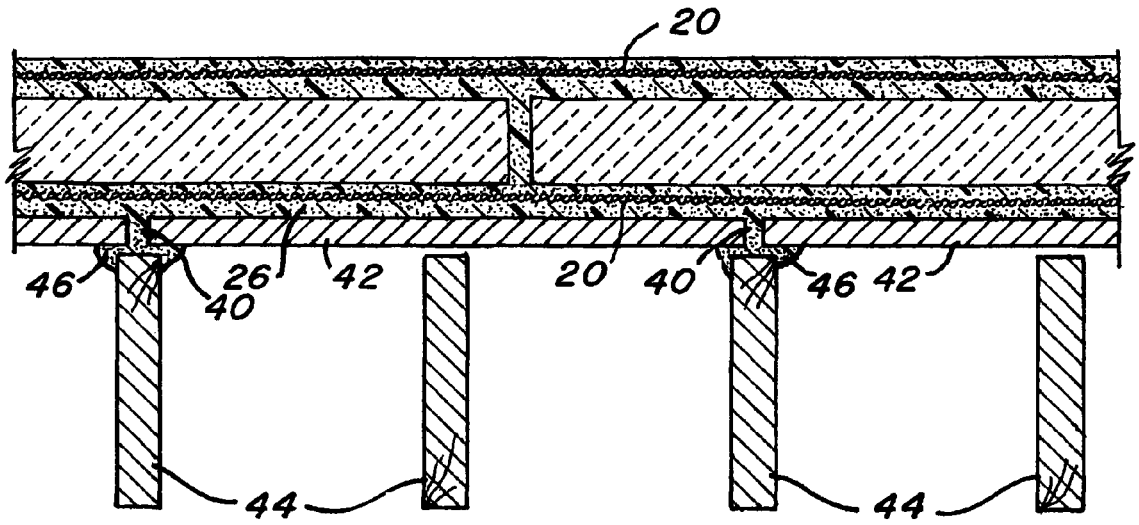
FIG. 6 is another embodiment hereof where the two layers of mesh are employed to improve overall rigidity and fire resistance.

Referring to FIG. 1, the roof structure 10 comprises a corrugated metal deck 12 having a plurality of partially overlapping sections 14. The metal deck 12 is fastened to an underlying support structure 16 by conventional means 18, such as by roofing screws. It is noted here for clarity that this roof structure is equally applicable to other deck configurations and structures such as wood, etc. A reinforcing mesh material 20 such as a fiberglass, nylon, plastic, polyester weft inserted polyester and fiberglass mesh (which is commercially available from JPS Glass Fabrics, Slater, S.C., (See FIG. 4 for mesh over deck joint embodiment) or other similar material mesh having similar or greater strength properties is located upwardly adjacent the deck 12. At various locations over the surface area of the roof deck 12, the mesh layer is mechanically attached to the deck 12. This is illustrated for example at numeral 22. Upwardly adjacent and in some areas (optionally) adhered to the deck sections 14 and through and around the mesh 20 is a material whose purpose it is to inhibit fluid passage therepast. Such material may be a polyurethane including polyurethane foam, may be a polyurea composition, may be another material having similar properties and may be a material having fire retardant properties. As illustrated, the material 26 is an expanding urethane foam 26. Foam 26 is illustrated in this figure as a single layer but it is to be understood that more layers may be utilized. Such would appear the same as shown in this figure. The already identified mesh 20 may be positioned anywhere within the layer(s) of foam, as desired and may cover any even small part thereof. Further, multiple small areas of the roof may be provided with mesh 20. Further still, more than one layer of mesh may be employed. (See FIG. 6 for example). The foam is positioned by being sprayed in place. In this particular embodiment the foam is sprayed through the mesh. The sprayed foam acts as an insulator as well as a structural member of the roof structure. Moreover, the sprayed foam is an effective air barrier (though not 100% seal, polyurea material provides 100% seal) to prevent air movement through or around the roof that would otherwise lead to inefficiencies with respect to thermal issues and strength/wind uplift issues. The air barrier component of the roof construction taught herein is the application of the foam material to specific areas at least of the roof deck 12 and a perimeter edge of the roof and at any penetrations of the roof and at fastener and deck overlap locations. The foam is placed at all of the overlapping edges of the deck panels 14 and at all penetrations through the roof and the roof perimeter. Roofing fastener penetrations are not, in this embodiment, directly sprayed because the bridging area 24 above a flute where such fasteners are located is sealed by the combination of the mesh 20 and the foam sealing the end of each deck section 14 and substantially filling an overlap flute 28 where two adjacent sections 14 overlap longitudinally (joint flute). Substantially filling the joint flute 28 with foam significantly increases structural strength and rigidity of the deck by creating a structural stud type member within the flute 14.

The reinforcing mesh 20 not only aids in adding structural integrity to the foam 26 but also causes the foam 26 to rise uniformly, thereby avoiding the otherwise common undulating surface of the foam 26. The undulating surface is caused by the foam approximating the corrugated decking material. Because the mesh bridges the flutes in the corrugated material, the foam 26 rises smoothly and more uniformly because the matrix of the mesh causes a more uniform distribution of the liquid coating like water through a screen for a uniform coating and/or rising of a foam coating.

After spraying foam 26, a temporary roof is achieved. The cured foam can be walked on and worked on yet is waterproof. The roof structure as disclosed further does not require insulation (although there is no prohibition to adding insulation) so there is nothing that needs to be covered immediately. This is beneficial in a number of ways such as making the rapid installation of the roof possible and the fact that the roofing membrane 34 that will be installed later according to art recognized procedures is not subject to damage by workers and machinery on the roof while any major construction is taking place.

Figure 2:
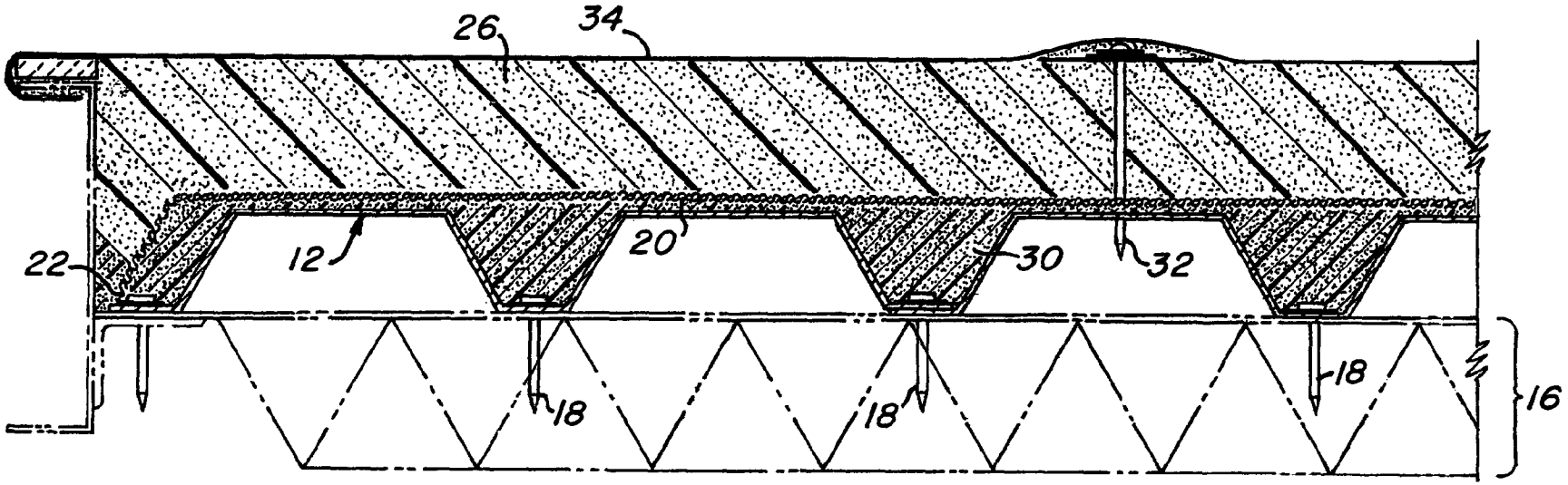
FIG. 2 is a cross-sectional elevation view of an alternate embodiment.

Referring to FIG. 2, a second embodiment of the foam-based roof structure is illustrated. This structure is similar to the FIG. 1 embodiment but employs a slow rise foam 30 in the first instance to substantially completely fill all of the low flutes in the deck 12 and to cover the high flutes. Mesh 20, the same as the mesh in FIG. 1, is then laid into the still uncured slow rise foam 30. The roof is then completed as was the roof in FIG. 1. The mesh in this embodiment will be more tightly adhered to the underlying deck and both the structural integrity and thermal efficiency will be improved over the FIG. 1 embodiment due to the addition of foam and the substantially complete filling of the low flutes in the deck.

In each of the embodiments described, a mechanical fastener 32 is optionally added to secure the cured foam "panel" to the underlying corrugated deck for both rigidity and wind uplift resistance as well as providing an underside attachment pad for waterproofing membrane attachment.

In both of the described embodiments, the strength of the whole roof structure is dramatically increased. Moreover, the structural rigidity and strength that is achieved is not subject to a loss of flexibility like in the case of a concrete or other inflexible material. The cured foam and scrim still have a sufficient degree of flexibility to avoid fracture. The arrangement also produces a flat roof construction which is aesthetically pleasing.

Figure 3:
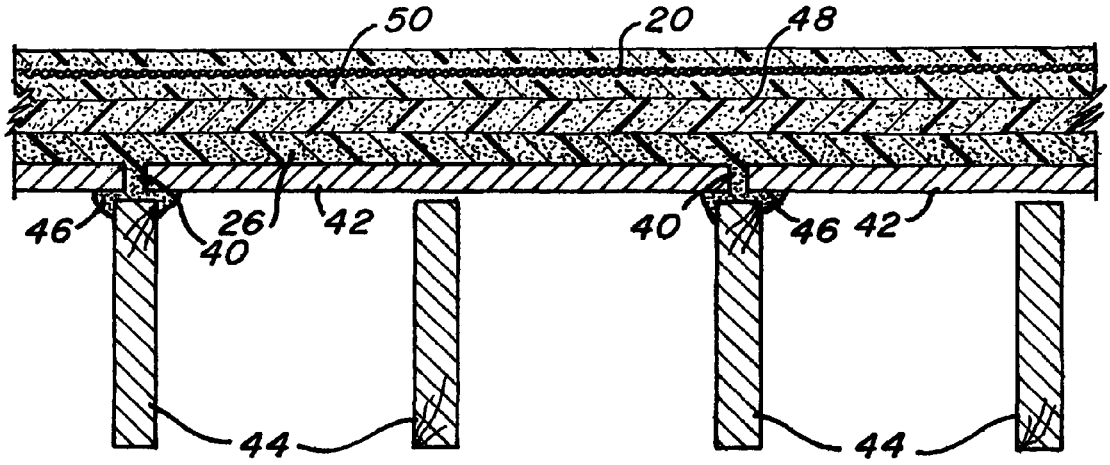
FIG. 3 is an alternative embodiment configured for use with a wood or other non-metal deck.
Figure 4:
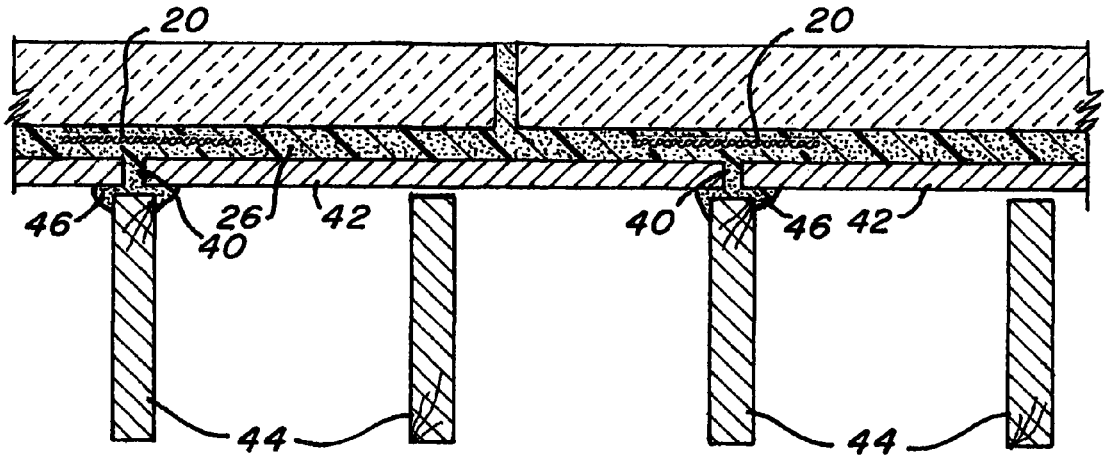
FIG. 4 is another embodiment hereof where the mesh is disposed only over deck joints.
Figure 5:
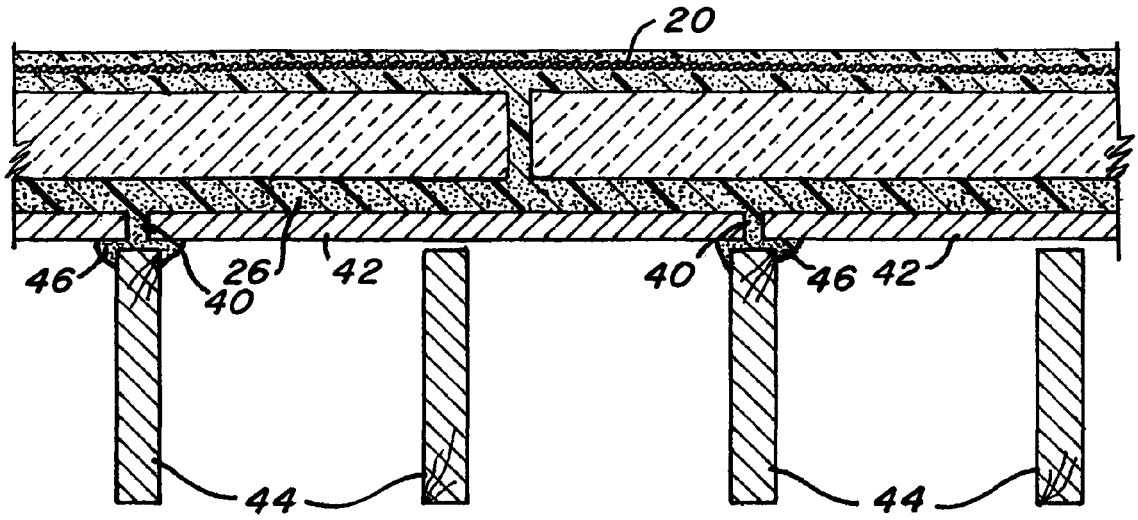
FIG. 5 is another embodiment hereof where the mesh is illustrated disposed upwardly adjacent an insulation layer.

Referring to FIGS. 3 and 4 the concept of the invention is applied to a wood deck. Because the foam 26 is in a liquid state when sprayed with a delayed foaming action, it easily migrates into joints 40 between plywood sheets 42. Moreover, the foam 26 also migrates under sheets 42 and around joists 44. As the foam 26 expands and cures, all of the joints will be sealed and the structure of the deck will be enhanced by the foam which has adhered and hardened into an additional material layer and into formations 46 around the joists, which resemble gussets.

In this construction, a second layer 48 of foam is applied over the first layer 26, followed by a third layer 50 embedded in which is mesh 20. The particular construction of the embodiment adds the second 48 and third 50 layers of foam to achieve a fire rating not obtainable by prior art wood deck roof systems.

In testing of both the metal and wood deck embodiments of the invention for wind uplift, the wood deck supported 130 psi vacuum before the joists failed (note the deck did not fail, the structure of the building failed). The metal deck supported 230 psi (the maximum psi vacuum available at Underwriters Laboratories) without failure. Thus, these embodiments are vastly superior to the prior art in structural strength while remaining extremely easily installed.

While preferred embodiments have been shown and described, various modifications and substitutions may be made thereto without departing from the spirit and scope of the invention. Accordingly, it is to be understood that the present invention has been described by way of illustration and not limitation.

The invention claimed is:

1. A roof assembly comprising:

a spray foam air sealed roof deck made of panels attached to structural supports, the spray foam being in the roof deck joints, fastener holes and small penetration through roof deck holes to stop air infiltration, said roof deck being disposed upwardly adjacent of an underlying support structure;

perimeter and large penetration nailers, walls, and curbing are spray foam air sealed for horizontal air flow into the roof assembly;

rigid roof insulation boards upwardly adjacent adhered to the spray foam air sealed deck with spray foam; and additional spray foam upwardly adjacent the rigid roof insulation boards and a layer of reinforcing fiberglass mesh therein, said reinforcing fiberglass mesh being attached to said roof deck and said underlying support structure via a mechanical fastener driven through said mesh and said deck, and penetrating into said underlying support structure.

2. A roof assembly as claimed in claim 1 wherein the spray foam is polyurea coating.

* * * * *